US005713277A

United States Patent [19]

Szarka

[11] Patent Number: 5,713,277

[45] Date of Patent: Feb. 3, 1998

[54] COMBINATION PRINT HEAD AND PIVOTABLE PRINT SCREEN HOLDER AND METHOD FOR IMPROVED OPERATOR SAFETY DURING SCREEN MAINTENANCE

[75] Inventor: Sandor Szarka, Franklin Lakes, N.J.

[73] Assignee: Svecia USA, Inc., Oakland, N.J.

[21] Appl. No.: 658,609

[22] Filed: Jun. 5, 1996

[51] Int. Cl.[6] ..... B41F 15/34; B41F 15/42

[52] U.S. Cl. ..... 101/123; 101/127.1

[58] Field of Search ..... 101/115, 123, 101/127.1, 128.1

[56] References Cited

U.S. PATENT DOCUMENTS

| | | | |
|---|---|---|---|
| 4,254,707 | 3/1981 | Lambert et al. | 101/127.1 |
| 4,493,254 | 1/1985 | Landesman et al. | 101/115 |
| 4,817,523 | 4/1989 | Harpold et al. | 101/123 |
| 4,939,991 | 7/1990 | Szarka | 101/115 |
| 5,022,320 | 6/1991 | Szarka | 101/127.1 |

FOREIGN PATENT DOCUMENTS

| | | | |
|---|---|---|---|
| 9738 | 1/1989 | Japan | 101/127.1 |

*Primary Examiner*—Stephen R. Funk

*Attorney, Agent, or Firm*—W. Patrick Quast, Esq.

[57] ABSTRACT

A multiple print head, automated screen printing machine is described with improvements for inspecting and cleaning a print screen. The print screen and its frame are locked securely in position within a print screen holder, which in turn is locked into a precise spacial relationship beneath a permanently installed print head frame. The rear edge of the print screen holder is hinged so that an operator can hand lift the holder upwards, or activate an air cylinder which causes the holder to pivot upwards at its front edge. Provisions are also made for moving the print carriage with associated squeegee(s) and flood bar(s) entirely away from the area occupied by the print screen holder. Print screen inspection and cleaning is accomplished without moving the print head frame, providing additional safety for operators during these maintenance procedures.

12 Claims, 7 Drawing Sheets

INITIAL POSITION

FLOOD STROKE

SCREEN DOWN

COMBINATION PRINT HEAD AND PIVOTABLE PRINT SCREEN HOLDER AND METHOD FOR IMPROVED OPERATOR SAFETY DURING SCREEN MAINTENANCE

BACKGROUND

This invention relates to screen printing, and in particular to screen printing machines utilizing multiple print heads cooperating with pivotable print screen holder assemblies.

Screen printing in its original inception involved a single screen on which a stencil was placed, the stencil so arranged as to block the passage of ink through the screen at selected areas. The screen holder was then filled with ink and a squeegee was used to force the ink through the opening in the stencil and through the screen, creating an impression on a substrate in contact with the screen. While this simple process is still used, today high speed automatic screen printing machines incorporating multiple print heads and associated print screens routinely process hundreds or even thousands of items per hour. One example would be today's popular T shirts upon which timely messages or scenes are depicted making use of current automatic screen printing technology.

Even in the case of highly automated screen printing equipment it is still often necessary for an operator of such equipment to inspect, or clean, or otherwise make corrections to an individual print screen during a production run of certain items. For example, in the above cited case of screen printing large numbers of T shirts, the process usually involves printing different colors in precise registration at different print heads on the same T shirt. It is important for the operator to inspect the print screen at frequent intervals to make certain the print screen is in correct registration with the object being printed upon. Additionally, the operator often must clean both the bottom and top surfaces of the screen to remove potential sources of contamination, such as, for example, lint collecting on the print screen from T shirts being imprinted.

During fabric processing the requirements for print screen inspection are often of the order of every ten to fifteen minutes. In the past, this inspection usually required lifting the entire print head and print screen either vertically on two or four pneumatically operated cylinders, or by pivoting the print head and its print screen at the rear edge of the print head away from and above the object to be printed upon. For example, in U.S. Pat. No. 3,795,189, issued Mar. 5, 1974, a multiple print head, multicolor screen printing machine is disclosed. In this invention pallet support plates carrying pallets containing the object to be printed upon are moved in a timed sequence from one print head and print screen to another. After the completion of a printing stroke (FIG. 5 in this patent) the print head assembly 60, and slightly thereafter, its associated print screen holder 85 are caused to be pivoted at their respective pivots 62 and 88. The front edge of the frame 61 is raised. After a slight delay, attained by the spacing between the limit stops 87A, 87B, the screen holder 85 is pivoted upwards at its front end 76, also. Obviously, in this position an operator has complete access to the bottom surface of the print screen.

In an alternate method used in the past, it was possible to pull the print screen outward and away from the print head for inspection and cleaning purposes.

While these past inventions and techniques provided useful aids for cleaning and inspecting print screens, they did not fully address the conveniences and simplifications of the procedures embodied in the instant invention. For example, in the past raising an entire print head to gain access to the print screen involved heavy duty cylinders to quickly move the print head. Print heads typically weigh several hundred pounds or more. In addition to requiring costly equipment to raise or pivot the print head its great weight posed a potential hazard to the operator performing cleaning procedures under the device should it accidentally move downward. And in the case of simply pulling the print screen away from the print head, it has often been the case that operators tend not to perform this operation for fear of not obtaining the precisely registered position required by the print screen when the print screen was moved back beneath the print head. In this case, operators often simply crawled under the print head to gain access to the under surface of the print screen rather than run the risk of returning the print screen out of proper registry for color imprinting.

Therefore a primary object of the invention is to provide operator access to the bottom and top surfaces of a print screen during a multiple print head screen printing procedure without the requirement for moving the print screen holder out of precise printing registry.

Another object of the invention is to provide operator access to the bottom and top surfaces of a print screen during a multiple print head screen printing procedure without the necessity for moving the print head frame assembly.

Another object of the invention is to provide for moving the flood bar(s) and squeegee(s) away from the plane occupied by the print screen without moving the print head frame assembly.

An additional object of the invention is to provide full access to the entire top surface and bottom surface of a print screen during a multiple print head screen printing procedure without moving the print screen holder out of precise printing registry, and without moving the print head frame assembly.

A further object of the invention is to provide additional operator safety while performing print screen cleaning and maintenance procedures during a multiple print head screen printing operation.

Still another object of the invention is to provide equipment offering simplified, safe operator access to a print screen during multiple print head screen printing in an economical manner.

SUMMARY

These and other objects are obtained with the combination print head and pivotable print screen holder assembly of the instant invention.

As discussed above, during multiple print head screen printing as practiced in the past, particularly when dealing with textiles to be printed upon, there is a frequent need to stop the screen printing machine in order to remove lint, dirt, dust or other contaminants from the underside of the screen.

This is traditionally accomplished by raising the entire print head, including the print screen holder, printing carriage, drives and the main structures which guide the printing carriage. Typical print head weights range from approximately 100 pounds to as much as several hundreds of pounds depending on the overall size of the print head.

The method of lifting and guiding the print head is accomplished either by pivoting it along its rear edge (farthest away from the operator side of the print head), or lifting it up parallel guided by either two or four columns. Obviously heavy duty equipment is required to enable this print head lifting and lowering. Designers of this equipment must devote great attention to preventing serious harm to personnel inherent in these designs. These safety considerations, together with the heavy duty lifting requirements, significantly add to the cost of manufacturing screen printing machines of this type.

In the instant invention the problems associated with print screen cleaning have been solved in a simplified and more economical manner. It has been discovered that the print head frame can remain firmly fixed in place. In this case the print screen holder is hinged at its rear edge (the edge farthest away from the operator), so that when the operator wishes to inspect and clean the print screen the operator can either hand lift the front edge of the print screen up, or flick a switch which will cause the front edge of the print screen to raise upwards above the area to be occupied by an object to be printed upon at an approximate 45° angle, thereby rendering complete access to the bottom surface of the print screen.

A brief description of typical screen printing procedures are in order to fully understand the advantages of the instant invention. A print screen holder together with its print screen are affixed beneath the print head frame. The print head frame provides the means for mounting the print carriage, one print carriage being mounted on the left arm of the print head frame and a matching print carriage being mounted on the right arm of the print head frame. The purpose of the print carriages is to provide one (or more) flood bars and one (or more) squeegees transversely positioned over the top surface of the print screen. Once a pallet support plate, together with its pallet and object to be screen printed upon, is in place and in proper registry beneath the print screen holder, the print carriages move the flood bar(s) which in turn flood the upper surface of the print screen with ink. At this point the screen is lowered, followed by the lowering of the squeegee(s), and the print carriages now move the squeegee(s) to the rear of the print screen, causing the ink to be selectively imprinted upon the print object. The screen moves up, then the pallet support plate moves on to the next print head, another pallet support plate moves into printing position beneath the print head, and the printing cycle is repeated.

One version of the instant invention performs this procedure in the following manner. The print head frame is substantially rectangular in shape, with a rear edge, a left side, a right side and a completely open front edge. Two printing carriages containing one (or more) flood bars and squeegees are mounted on the print head frame, one carriage on the left side of the print head frame, and the second on the right side of the print head frame. Two vertically movable rods on the left and right sides of the head frame connect to respective arms of a print screen holder lift assembly located immediately beneath each of the frame sides and extending substantially the full length of each frame side. The print screen holder, together with its substantially rectangularly shaped print screen (although it obviously can be other shapes, such as oval, square, etc.), is positioned at its lateral sides on the vertically movable arms of the print screen holder lift assembly beneath the head frame sides, the rear edge of the print screen holder being located a spaced distance away from the rear edge of the frame. A drip pan is placed between the rear edge of the head frame and the rear edge of the print screen holder, the purpose of which will be more fully explained. An air cylinder is mounted adjacent the rear edge of the print screen holder, and beneath the drip pan, the air cylinder's associated rod and movable arm providing the connection to the print screen holder pivot bar located behind the rear edge of the print screen holder so as to enable the automatic raising of the front edge of the print screen holder upon activation of an electrical switch by the operator. The rear member of the print head frame supports an electric motor; and, associated means for providing the reciprocal motion to the print carriages are rotatably connected to the side members of the print head frame. The up and down motion of the vertically movable print screen holder lift assembly during actual printing procedures is provided by an air cylinder affixed to a structural rail of the screen printing machine, the cylinder providing the means for activating bell cranks positioned within the left and right sides of the print head.

A control console adjacent the front edge of one side of the print head frame contains the required electrical switches for activating the electric motors, air flow to the various air cylinders, solenoids, etc., required for the various functions of the screen printing machine. During a printing operation the flood bar will move from the rear edge of the print screen to the front edge, flooding the screen with ink. Then the squeegee pushes downward against the print screen so as to have the print screen make contact with the print object beneath the print screen, and the squeegee is moved against and over the print screen until it reaches the rear edge of the print screen. At this point the squeegee automatically raises above the print screen, and the flood stroke is repeated. The flood bar itself normally remains stationary as to height above the print screen, with the print screen holder being raised instead to make contact with the flood bar during the flood stroke, and then being lowered to permit contact with the print object during the print (squeegee) stroke.

The instant invention provides the operator with important new and simplified procedures for print screen inspection and cleaning. For example, the operator can simply stop the machine after the completion of a print stroke, with the flood bar and squeegee adjacent the rear edge of the print screen. Then activating a control switch for what is termed a "Park One" position causes the flood bar and squeegee to be raised a spaced distance above the print screen holder. In this "Park One" mode the operator can now make quick inspections of the print screen, the flood bar and squeegee, and also hand raise the front edge of the print screen holder for quick inspections of the bottom surface of the print screen. If a more complete inspection is required, the operator simply activates what is termed the "Park Two" switch which causes the print carriages to move rearward over the drip pan and completely away from the surface of the print screen. At the same time the print screen holder is pivoted at its rear section so that the front edge of the print screen holder moves upward from its original position at an approximate 45° angle. In this mode the entire bottom surface of the print screen is now fully accessible to the operator. It is important to note that the print screen holder and its associated print screen is relatively light in weight, posing little if any danger to an operator working beneath the print screen.

Another important advantage of this "Park Two" mode, that will be appreciated by those skilled in the art, is that the flood bar-squeegee combinations are completely away from the top surface of the print screen. In this "Park Two" mode the relatively light weight of the print screen holder enables the operator to simply hold the print screen holder down while inspecting and cleaning the top surface of the print screen. Prior to the disclosures of the instant invention, the flood bar and squeegee remained in place either at the front edge or rear edge of the screen, inevitably hindering to some degree operator maintenance of the top surface of the screen.

All of these significant improvements in print screen maintenance are accomplished without compromising the quality of the screen printed product. Once proper registration between the print screen and print object is obtained, it is maintained during inspection and cleaning procedures. The print screen holder remains locked in its original spacial arrangement, merely being hinged upwardly for cleaning purposes, and then returning precisely to its original position, in the exact original registry with the print object.

It is important to note that the instant invention provides the above mentioned benefits by eliminating costly heavy duty lifting equipment, adding only a relatively inexpensive air cylinder or other suitable relatively simple device to effect the required raising of only the light weight print screen holder.

DETAILED DESCRIPTION

Figure 1:
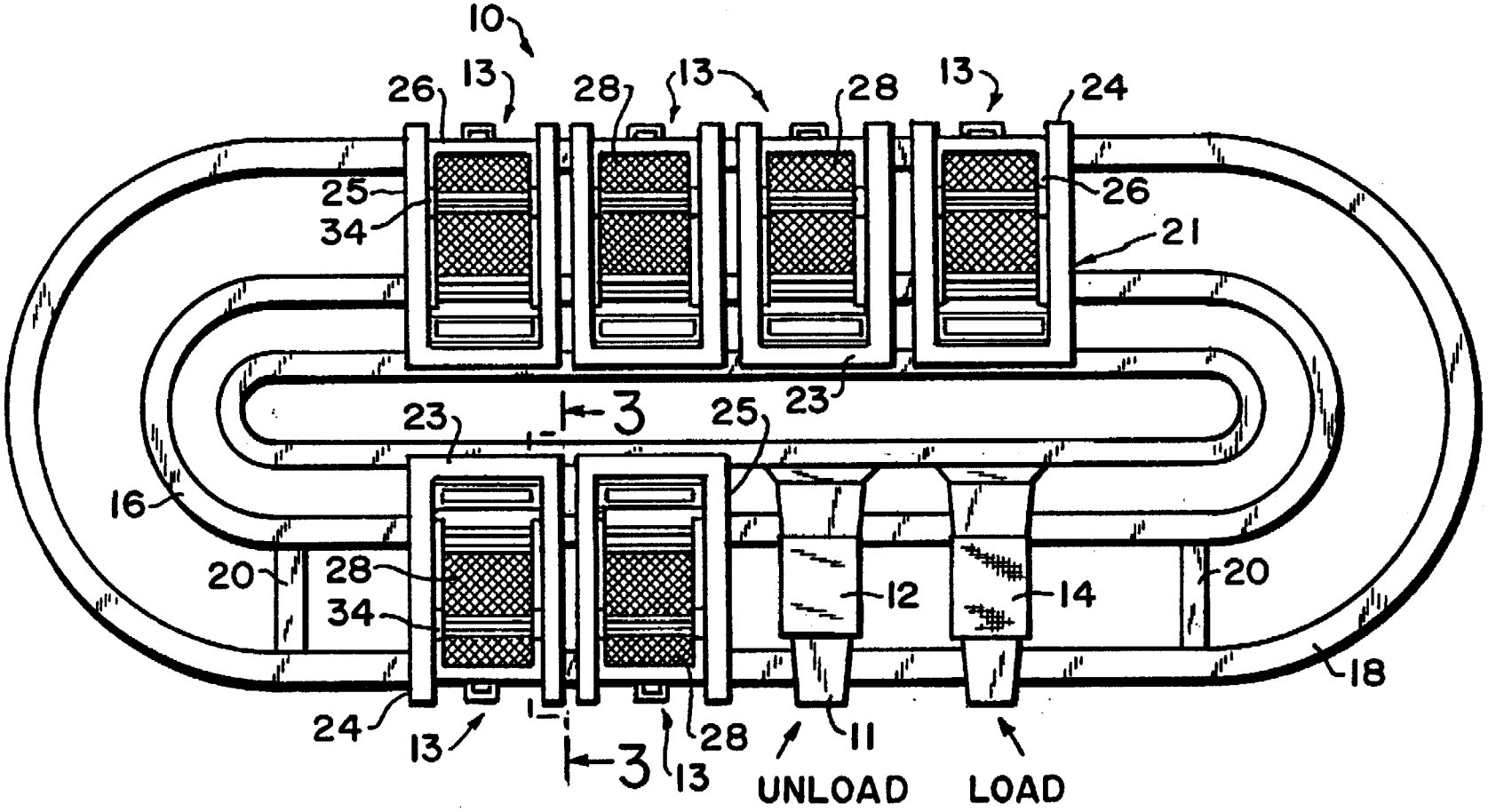
FIG. 1 is a top plan view of one version of the combination print head and pivotable print screen holder assembly incorporated in an oval shaped, multiple print head screen printing machine.
Figure 2:
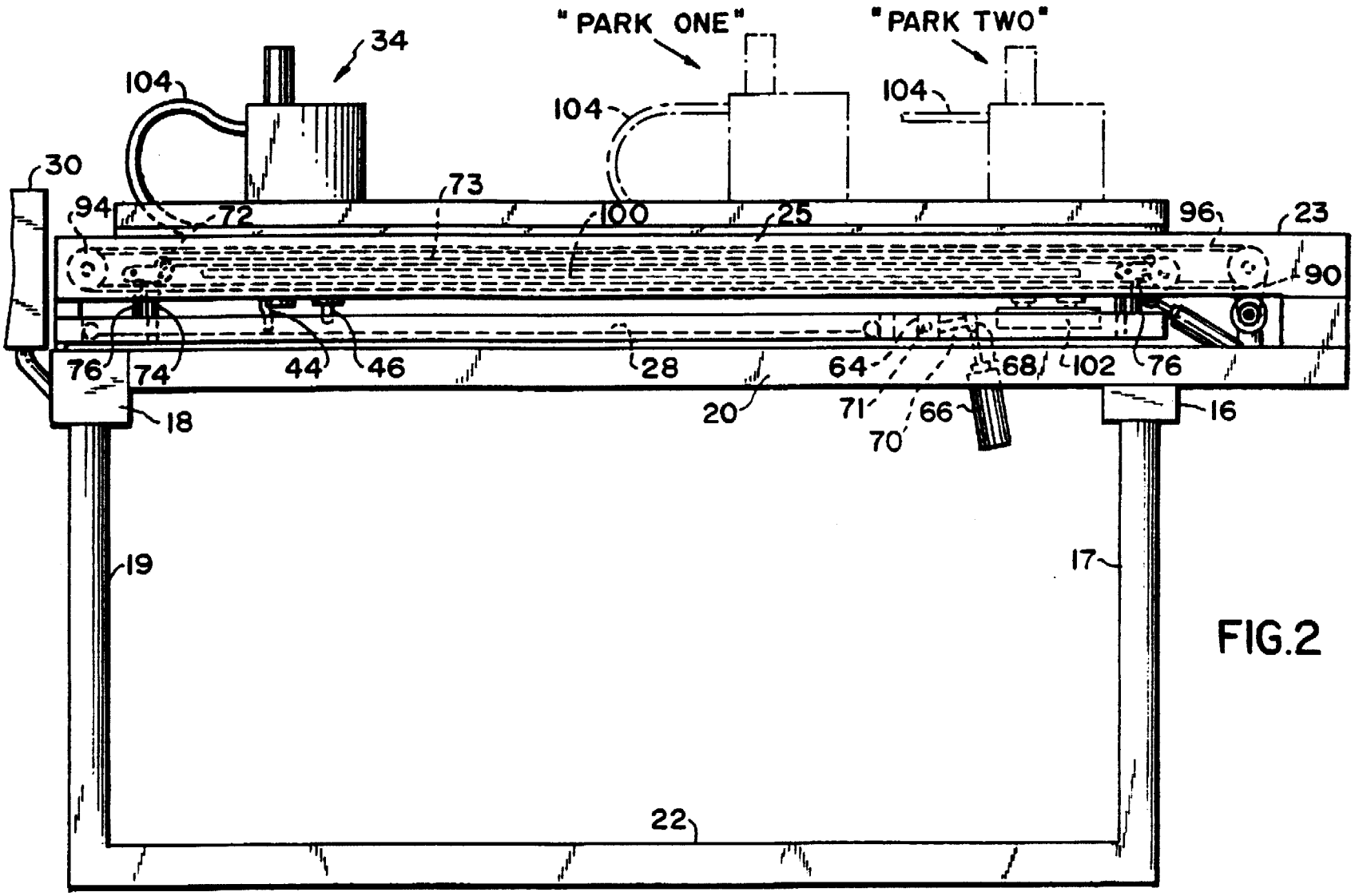
FIG. 2 is a side elevation, partially sectional view of one version of the combination print head and pivotable print screen holder assembly, illustrating a normal print carriage stroke, and in dotted lines the "Park One" and "Park Two" positions for print screen inspection and cleaning procedures.

Turning now to the drawings wherein similar structures having the same function are denoted by the same numerals throughout the various views, in FIG. 1 an oval shaped screen printing machine 10 is depicted. Six print stations 13 are shown located about an inner rail 16 and outer rail 18, with rails 20 interconnecting the inner and outer rails forming a support structure for the print heads. As can be seen in FIG. 1 each print station 13 is comprised primarily of a print head frame 21 having a rear edge 23, a left hand print head arm 25, and a substantially parallel right hand print head arm 24 extending in a horizontal plane to each other from the rear edge 23 of the print head to the front or loading area of the machine. As seen in FIG. 2 additional rail support members connect the outer rail 18 to a rail member 22 adjacent the floor on which the screen printing machine rests via a first vertically positioned rail 19, while a second vertically positioned rail 17 connects the inner rail 16 to the rail member 22 adjacent the base of the machine.

In operation, an object 14 to be screen printed upon would be placed on a pallet 12 supported by a pallet support plate 11 at the "load" area depicted. The pallet support plate would then be moved about the oval rail in a timed sequence, being precisely located and registered beneath each of the print stations at timed intervals so as to receive the particular color imprint at each of these stations. While the process is largely automatic, it is often necessary for an operator to stop the printing in order to inspect and clean at least the bottom surface (the surface to contact the print object) of the print screen.

Figure 3:
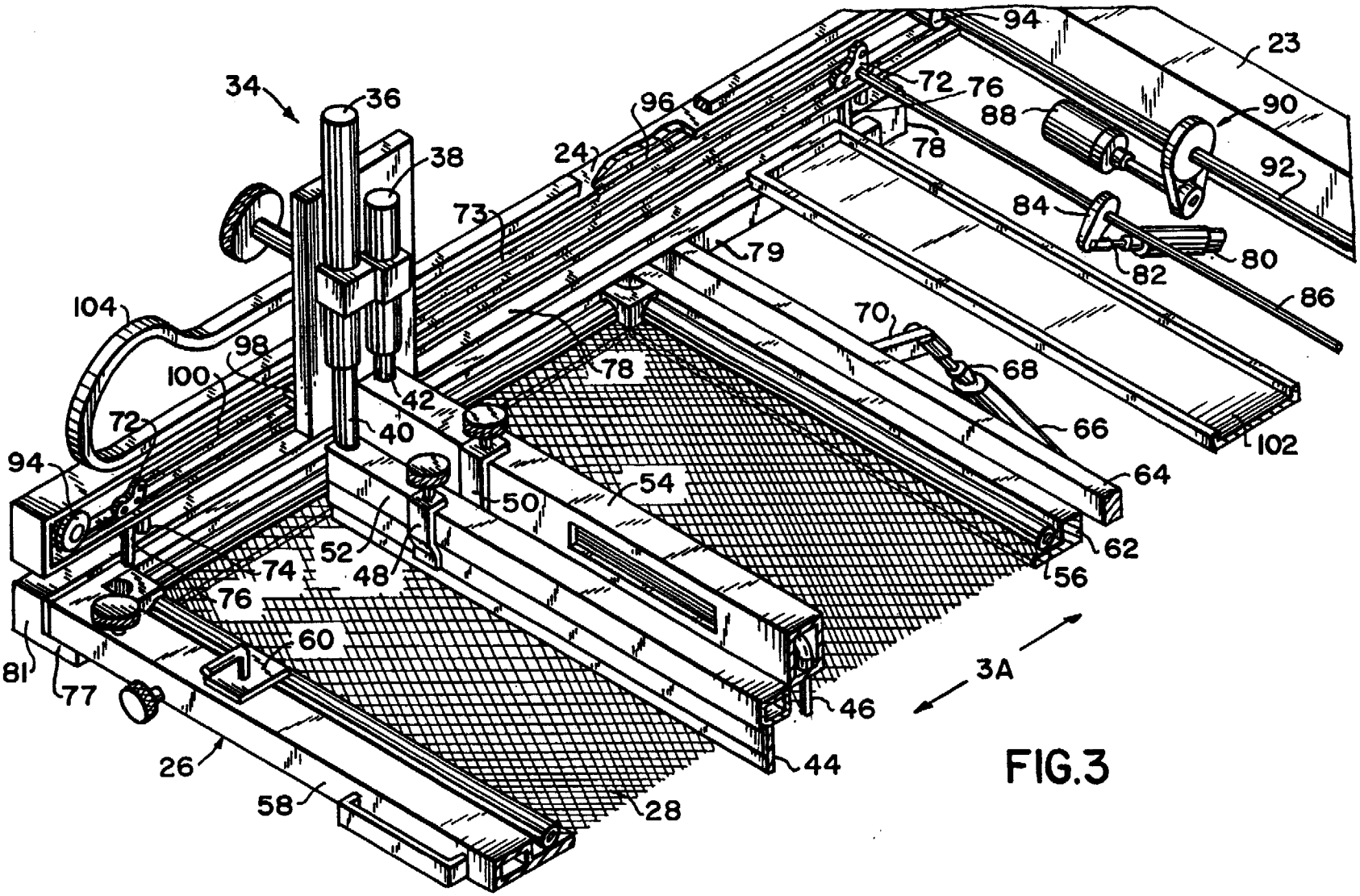
FIG. 3 is a perspective, partially sectional view of the print head, pivotable print screen holder, and print screen, and members required for the proper functioning of this version of the invention.

In FIGS. 4A–4G a typical printing sequence is schematically depicted. In the "Initial Position" of FIG. 4A the print carriage 34 which contains the required squeegee 44 and flood bar 46, as will be more fully explained, is shown adjacent the rear print screen holder bar 62 (FIG. 3). The print screen 28 within its holder 26 is shown in contact with the flood bar 46, with the print screen 28 positioned above and out of contact with the print object. During the depicted "Flood Stroke" of FIG. 4B the print carriage 34 moves to the front edge 58 (FIG. 3) of the print screen holder 26, having now flooded (not shown) the print screen 28 with ink. In the "Screen Down" illustration of FIG. 4C, the print screen is shown having been moved in a downward direction so as to be in close proximity to the print object 14. The next "Squeegee Down" illustration of FIG. 4D now shows the squeegee having been lowered so that it makes contact with the print screen and biases the print screen downward against the print object. In the next "Print Stroke" depiction of FIG. 4E the print carriage 34 is shown having caused the squeegee to transversely move across the top surface of the print screen while simultaneously forcing the ink (not shown) on the surface of the print screen to be passed through the screen, and thereby imprinting the print object. In the next "Squeegee Lift" depiction of FIG. 4F the squeegee 44 is now shown to be raised above the top surface of the print screen. Finally, in the "Return To Initial Position" illustration of FIG. 4G the print screen holder 26, together with its print screen 28, is shown having been raised a space distance above the print object 14, with the flood bar 46 now in contact with the print screen.

Figure 5:
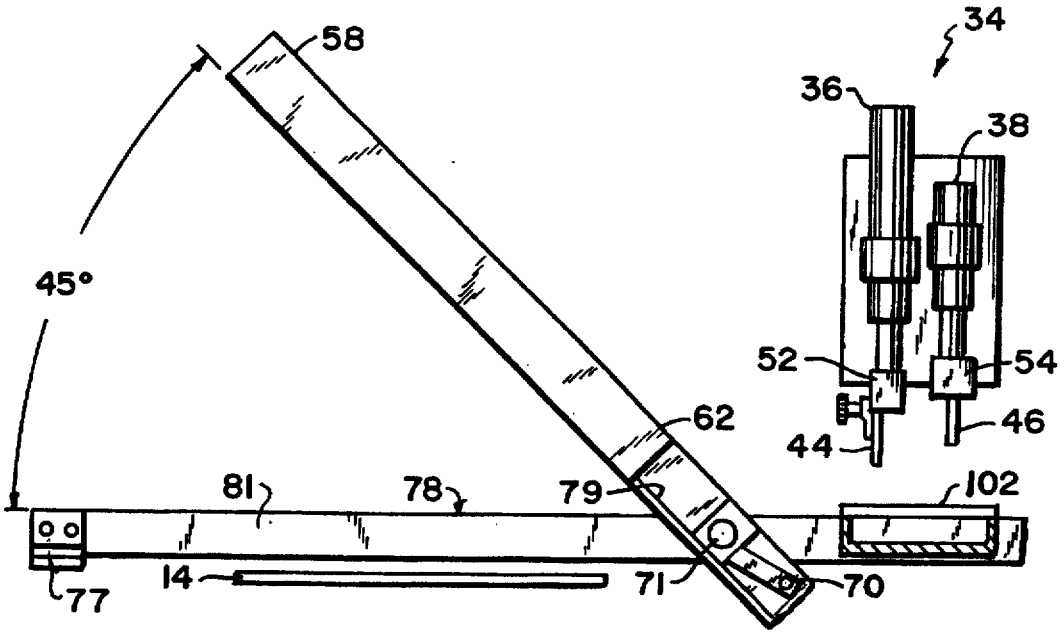
FIG. 5 is a schematic illustration of one version of the invention, showing the print carriage with raised squeegee and flood bar positioned over the drip pan, providing complete access to the bottom and top surfaces of the print screen for inspection and cleaning procedures.

FIG. 5 is a schematic illustration of an important aspect of the invention. Simply pressing an electrical switch 32 on the control console 30 (FIG. 3B) at the conclusion of a print stroke (the "Squeegee Lift" depiction of FIG. 4F) causes the print carriage to be moved rearward completely away from the print screen holder 26 and print screen 28, and over the drip pan 102. At the same time the print screen holder pivots upwards at its front end, making both bottom and top surfaces of the print screen completely accessible for inspection and cleaning. This is the named "Park Two" position for servicing of the print screen. A similar schematic illustration of the named "Park One" servicing position is shown in the "Squeegee Lift" depiction of FIG. 4F. In this "Squeegee Lift" illustration the print screen holder can be lifted up at its front end 58 by hand for quick inspecting and cleaning procedures. It is to be noted that while these schematic depictions of FIGS. 4A–4G and 5 show the squeegee and flood bar being raised vertically above the print screen holder, other spacial arrangements can also be employed, such as, for example, tilting the squeegee(s) and flood bar(s) away from the top surface of the print screen.

Figure 3A:
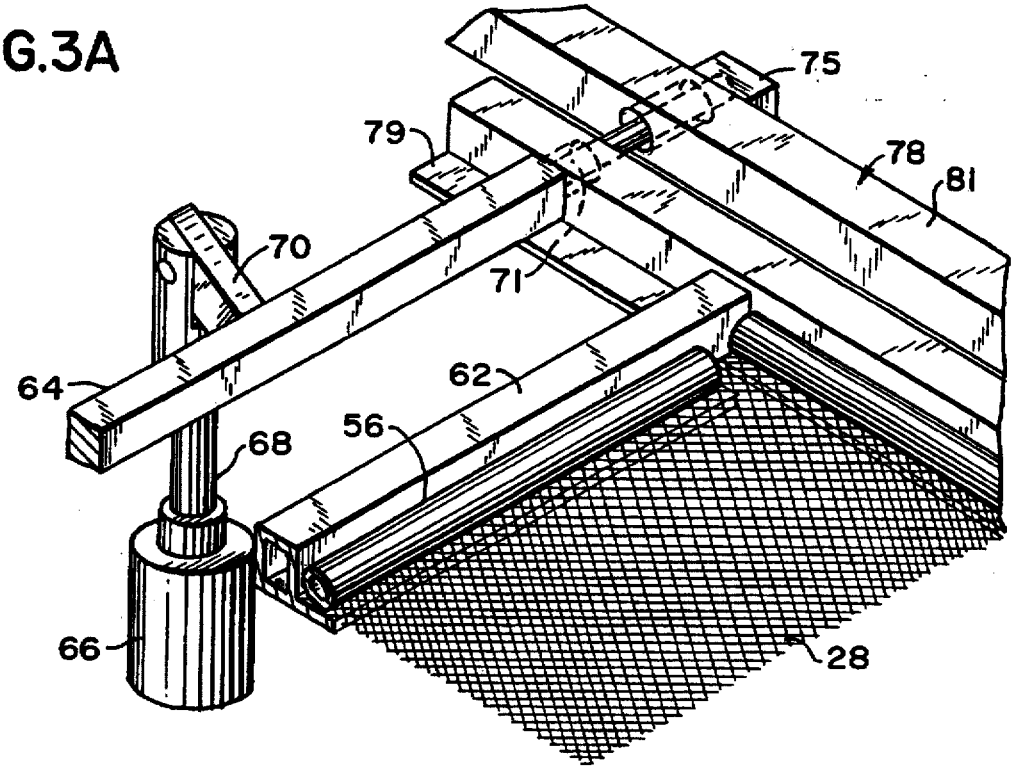
FIG. 3A is a sectional view, taken along the area denoted by the arrow 3A in FIG. 3 as a mirror image of this area, showing the pivot stud connection (shown partially with dotted lines) to the side of the print screen holder of one version of the print screen holder of the invention.
Figure 3B:
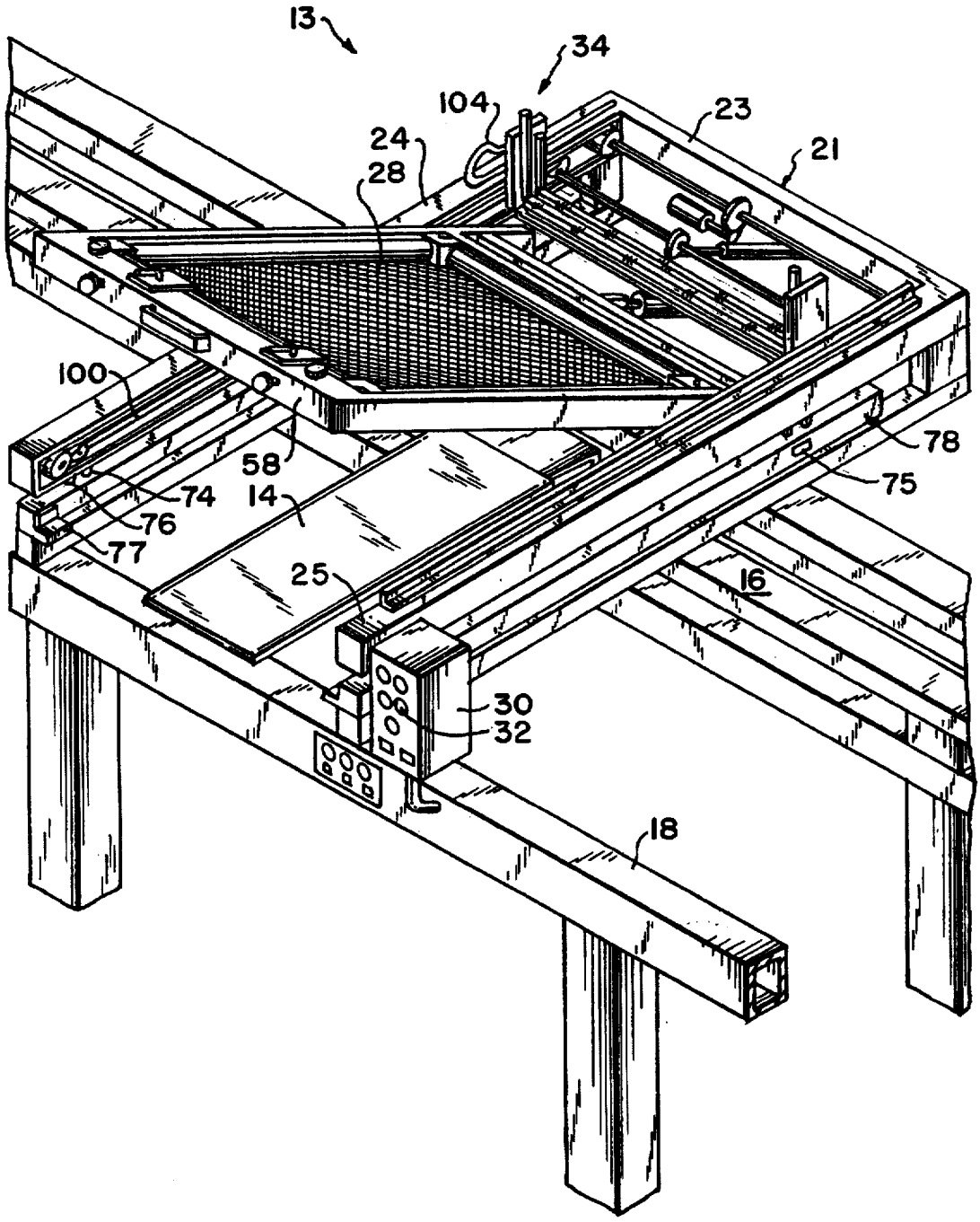
FIG. 3B is a perspective view of one version of the combination print head and pivotable print screen holder assembly of the invention, showing the print screen holder as pivoted upwards for the purpose of inspection.

FIGS. 2, 3, and 3A illustrate in detail the construction of one version of the combination print head and hingeable print screen holder assembly of the invention. The print head 21 consists substantially of three sections, a rear edge and two arms extending from the rear edge. The print head rear edge 23 is joined at its right side by an outwardly extending print head right arm 24, and at its left side by an outwardly extending print head left arm 25. The print head is supported in a horizontal plane by the inner 16 and outer rails 18 of the screen printing machine 10 support structure, with the rear edge of the print head being located farthest away from the loading area of the pallet support plate, the front area of the print head adjacent the loading area being open and fully accessible to the print screen holder 26. At least one print carriage 34 is connected to the print head right arm 24, and a matching print carriage is connected to the print head left arm 25. A flood bar pressure bar 54 and a squeegee pressure bar 52 are connected to each print carriage, the pressure bars transversing the print screen 28, being in a substantially parallel plane to the rear edge 23 of the print head. Rods 98 connected to each print carriage join each carriage to a print carriage guide bar 100, which in turn is connected to, and extends substantially the full length of, each of the print head arms. Also running substantially the full length of each of the print head arms is a timing belt 96 which rotates about two idler rollers 94, one idler roller being affixed at both ends of each print head arm. Pins (not shown) projecting from the print head carriage connecting rods 98 provide the means for moving the print carriage in a reciprocal motion along the side of the print screen during a printing operation. A rotatable bar 92 located within and extending the length of the rear edge 23 of the print head interconnects with the idler rollers 94 at a rear section of each of the print head arms. An electric motor 88 and associated rotating belt assembly 90 situated at the middle of the rotatable bar provide the means for powering the reciprocal motion of the print carriages via the pins projecting from the rods 98 (not shown) which engage the timing belt 96, the point of engagement not being shown.

A bell crank 72 (performing the function of a screen holder lift) is affixed substantially at each end of each print head arm, each pair of bell cranks 72 being interconnected by a rod 73. The bell cranks 72 connected at the rear end portion (adjacent the rear edge of the print head frame) of both print head arms are interconnected by a rigid bar 86, said bar having a movable arm 84 connected to the rod 82 of an air cylinder 80 attached at the middle of the bar. Beneath both print head arms and extending substantially the full length of the arms in the same vertical plane as the print head arms are respective arms of a print screen holder lift assembly 78. The lift assembly arms, e.g. 81, are connected at each of their end sections by slidably engaging guide rods 74 to each of the print head arms, and a pair of movable connecting links 76 also connect each lift assembly arm to bell crank 72.

The print screen holder 26 is positioned between the lift assembly left and right arms 81, and is located a spaced distance away from the rear edge of the print head, this space being occupied by the drip pan 102. The print screen holder is substantially rectangular in shape, having a left and right side, and a rear screen holder bar 62 (adjustable from front to back depending on the size of the print screen), and a front screen holder bar 58. The left and right sides 79 of the print screen holder are supported at their front end by respective "L" shaped brackets 77 extending laterally from print screen holder lift assembly side arms, 81. At their rear end, sides 79 are pivotally supported by side arms 81 via pivot stud 71 affixed to either end of print screen holder pivot bar 64, integral with the print screen holder frame and positioned behind the rear screen holder bar 62. The print screen holder pivot bar 64 has a pivot stud 71 affixed to both ends. The pivot stud 71 extends through the holes (see FIG. 3A) in the left and right sides 79 of the print screen holder, and through holes in the left and right, print screen holder lift assembly side arms 81. The pivot studs are secured to the print screen holder lift assembly side arms 81 by a pivot stud bushing 75 on the outer surface (away from the left and right sides of the print screen holder) of both sides of the lift assembly side arms 81. A printing screen holder lift tilt cylinder 66 is located immediately behind and below the print screen holder pivot bar 64, with its tilt lift arm 70 being connected to the print screen holder pivot bar 64.

The print screen 28 itself, in this case, is rectangular in shape, being secured at its edges by a round (or square) shaped screen frame 56 so that the print screen is maintained in a taut condition. The screen frame 56 is secured within a channel on the inner surface of the left and right sides of the print screen holder and its rear screen and front screen holder bars. The screen frame is firmly anchored in place in the print screen holder by a pair of clamps 60 positioned on the upper surface of the front screen holder bar 58.

A typical screen printing procedure making use of the combination print head and hingeable print screen holder of the invention would proceed in the following manner. Once a pallet 12 and print object 14 is properly registered beneath a print head, the flood bar pressure bar is moved from the rear of the print screen to the front. The flood bar 46 itself is attached by clamps 50 connected to the flood bar pressure bar 54, and a flood bar air cylinder 38 mounted on each of the print carriages provides the means for moving the flood bar pressure bar cylinder rod 42 up and down as required by the printing cycle. At the same time the squeegee 44, which is connected by means of clamps 48 to the squeegee pressure bar 52, is moved from the rear of the print screen to the front. A 2-stage pressure cylinder 36 and its cylinder rod 40, on each of the print carriages, is connected to the squeegee pressure bar, and provides the means for moving the squeegee up and down as required by the print cycle. The print carriage(s) on each print head arm are moved back and forth along the length of the arms by means of the electric motor 88 powered timing belt 96. Electrical control signals necessary to activate cylinders 36 and 38, at different times in their respective cycles, are provided to the print carriage assemblies 34 via connecting flexible conduit 104. In this initial flood stroke the flood bar is in contact with the print screen, thereby flooding the print screen with ink, while the squeegee remains a spaced distance above the surface of the print screen. At this point the print screen holder lift assembly 78 is lowered by means of the screen holder lift cylinder 80 and its associated cylinder rod 82 and movable arm 84, enabling the print screen to be positioned in close proximity to the print object 14. At this time the squeegee is also lowered, biasing the print screen into contact with the print object. The print carriage now returns to the rear of the print screen. The process is then repeated as each new pallet support plate 11 and its associated pallet 12 and print object are precisely positioned beneath the print head in a timed screen printing machine process.

Figure 4A:
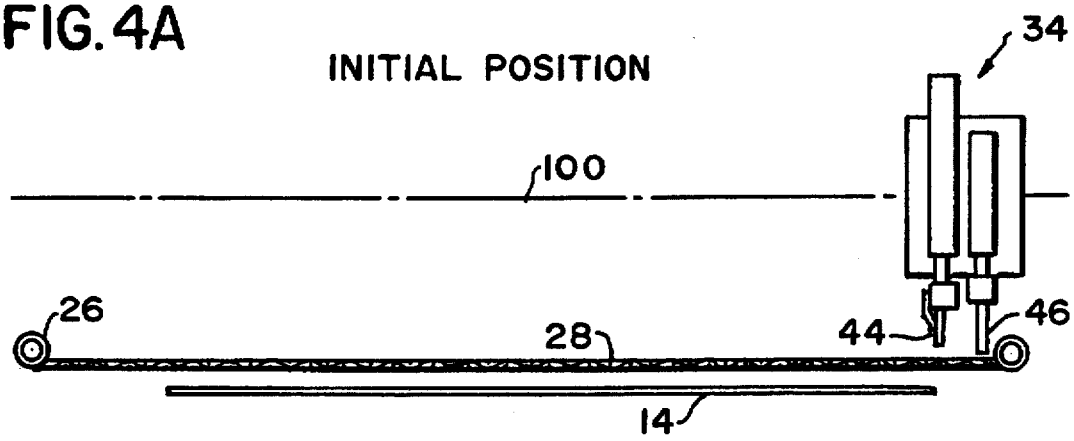
FIGS. 4A–4G is a flow chart schematically illustrating a typical printing sequence of a screen printing machine.
Figure 4B:
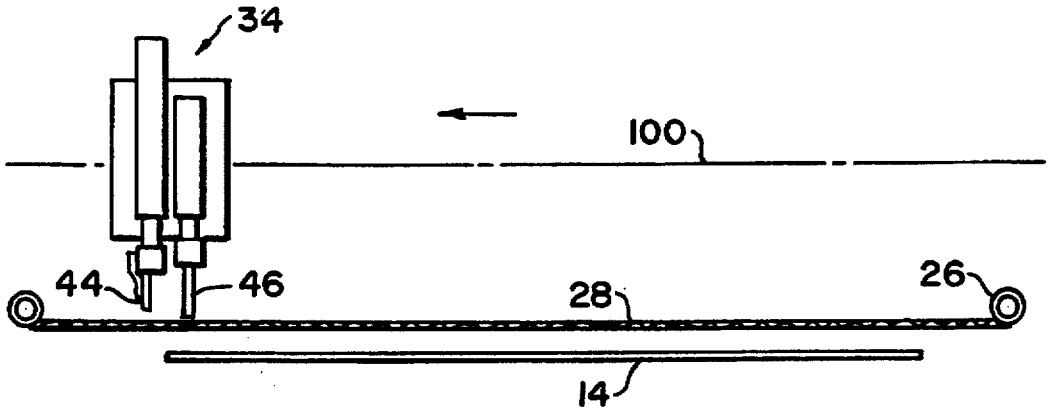
Figure 4C:
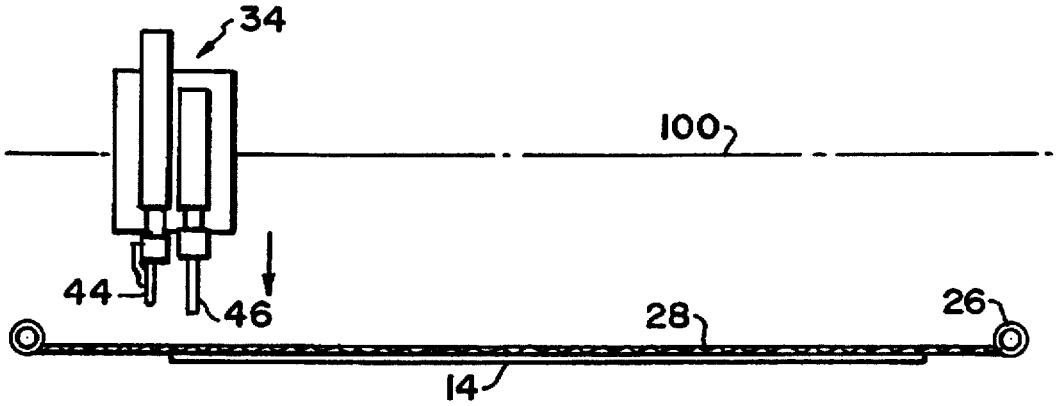
Figure 4D:
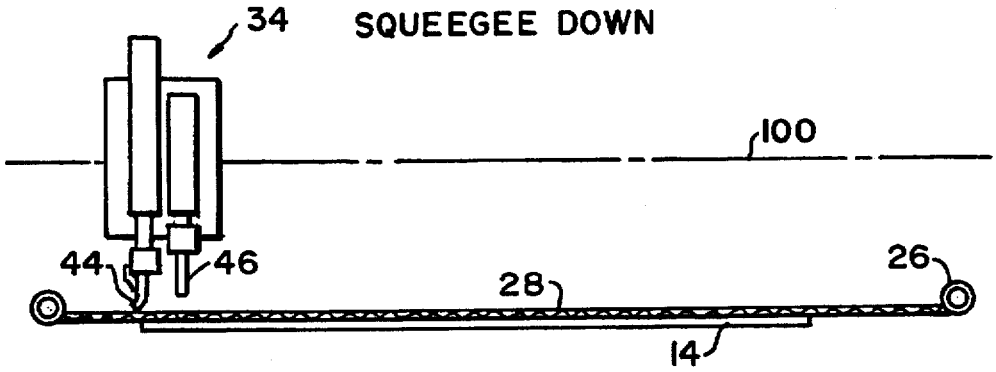
Figure 4E:
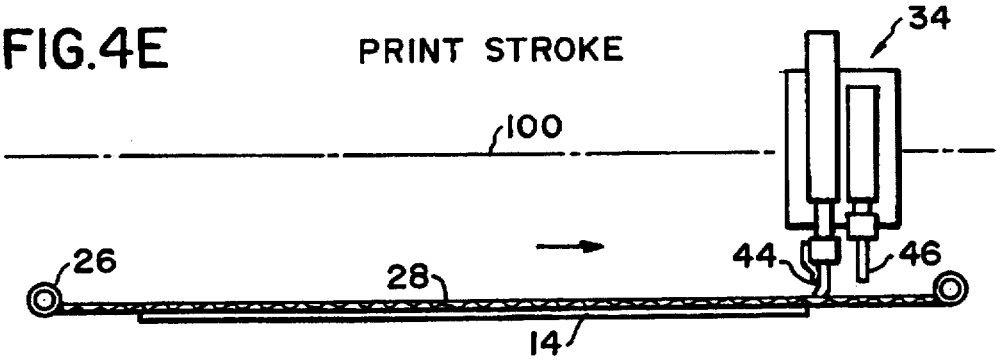
Figure 4F:
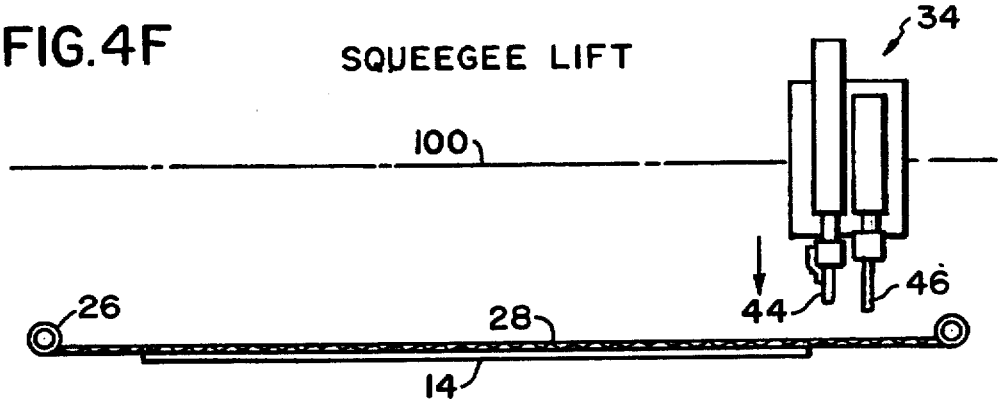
Figure 4G:
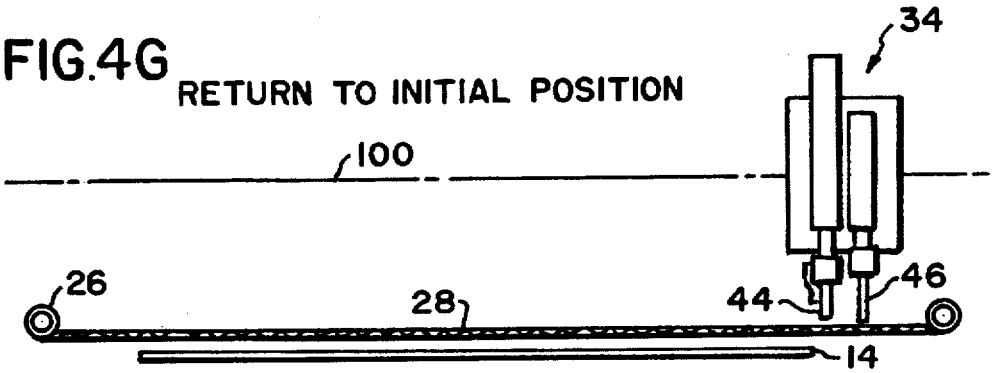

It is to be noted in the instant invention that the print head 21 is permanently secured in place, with only the lower, print screen holder lift assembly 78 moving up and down, and the front edge 58 of the print screen holder 26 pivoting upwards in response to air cylinders 66. The operator can stop the screen printing process at anytime by simply flicking an electrical switch 32 on the control console 30. For example, stopping the process in the "Squeegee Lift" position depicted in FIG. 4F gives rise to the "Park One"

position illustrated in dotted lines in FIG. 2. In this position, while the squeegee and flood bar are still over the print screen, the operator can still make quick inspections and cleaning procedures by simply hand lifting the front edge 58 of the print screen holder. For a more thorough inspection and cleaning procedure the operator turns on the "Park Two" electrical switch which causes the print carriage to move back and completely away from the print screen holder (shown in dotted lines as "Park Two" position in FIG. 2), with the squeegee and flood bar now positioned over the drip pan 102 so as to catch any ink droplets falling off of the squeegee and flood bar. At the same time the screen holder tilt cylinder 66 and its associated cylinder rod 68 and cylinder arm 70 now cause the print screen holder to be tilted upwards at it front edge (FIG. 5) by rotating the print screen holder pivot bar 64 about the pivot studs 71. With the print screen in this position, locked safely by the action of the cylinder, the operator now has full access to the bottom surface and the top surface of the print screen. The relatively light weight of the print screen holder, in contrast to the previous methods of lifting or pivoting the entire print head, now provides the operator with a safe operating environment for cleaning beneath the screen. A unique additional benefit is that in cleaning the top surface of the print screen, the operator has full access to this surface without being partially interfered with due to the presence of a squeegee(s) or flood bar(s), which was the case in the past. Once the inspection and cleaning procedures are accomplished, simply flicking another electrical switch returns the print screen holder to its down and operating position, and returns the print carriage over the print screen, ready to resume the printing process.

Thus it can be seen that the instant invention of a combination print head and hingeable print screen holder provides important new economies, and improved operator safety in automatic, multiple print head screen printing machines. While the various components of preferred embodiments described above disclose electrical motors, air cylinders, and the like, these conventional powering devices are employed merely as illustrative of the fabrication of the invention, and, of course, other conventional suitable devices can be substituted to accomplish the same functions detailed above.

While versions of the present invention have been shown and described in detail, various modifications and improvements thereon will become readily apparent to those skilled in the art. Accordingly, the spirit and scope of the present invention is to be limited only by the following claims.

What is claimed is:

1. A combination print head and print screen holder lift assembly for use in a multiple print head screen printing machine for screen printing on an object, comprising:

(a) print head means including a print head frame, said frame being permanently fixed in position within said machine, and including a left arm and a right arm positioned in a substantially horizontal first plane in relationship to each other, said arms being substantially parallel to each other and a spaced distance apart in said horizontal first plane;

(b) a print screen holder lift assembly disposed below said first plane, said assembly including respective left and right arms;

(c) a print screen holder having a left side and a right side, and a front end and a rear end, means for movably securing said print screen holder left side and right side between said left arm and said right arm of said lift assembly;

(d) a print screen, said print screen having a top surface and a bottom surface, said print screen being secured at its outer edges by means for securing said print screen within said print screen holder;

(e) said print head means further including a print carriage means positioned on said print head frame, said print carriage means including a flood bar and a squeegee, said print carriage means including means for moving said flood bar and said squeegee in a reciprocating motion over said top surface of said print screen during a timed printing cycle of said screen printing machine;

(f) means for moving said print screen holder lift assembly between a first position and a second position;

(g) means for moving said flood bar and said squeegee into and out of operative spatial relationships with said print screen whereby said flood bar dispenses ink onto said print screen and said squeegee distributes said ink through said screen onto a print object to be printed upon; and (h) means for pivoting said print screen holder, affixed to said print screen holder, so as to be able to raise said front end of said print screen holder in a direction above and away from said print object to be printed upon during said printing cycle, so that at a time deemed appropriate by an operator of said machine said operator can stop said printing cycle and gain access to both said bottom and said top surfaces of said print screen for observation and maintenance procedures associated with said print screen.

2. The combination print head and print screen holder lift assembly according to claim 1, further comprising means for positioning said print carriage means beyond said print screen holder so that said flood bar and said squeegee are completely removed from said horizontal plane occupied by said print screen.

3. The combination print head and print screen holder lift assembly according to claim 2, further comprising a drip pan transversely positioned between said arms of said print screen holder lift assembly and beneath said flood bar and said squeegee when said flood bar and said squeegee are positioned completely removed from said horizontal plane occupied by said print screen.

4. The combination print head and print screen holder lift assembly according to claim 1, wherein said means for pivoting said print screen holder includes means for automatically pivoting said rear end of said print screen holder and thereby raising said front end of said holder.

5. The combination print head and print screen holder lift assembly according to claim 4 wherein said means for automatically pivoting said rear end of said print screen holder comprises a fluid powered cylinder connected by means of a pivotable arm to said rear end of said print screen holder.

6. The combination print head and print screen holder lift assembly according to claim 1 wherein said means for movably securing said print screen holder left side and right side between said left arm and said right arm of said print screen holder lift assembly comprises an "L" shaped bracket affixed, respectively, to each of said print screen holder lift assembly left and right arms in contact with said print screen holder, so that when said print screen holder is secured at its left and right sides within said print screen holder lift assembly left and right arms said operator can cause said print screen holder to be raised above said print object for observation and maintenance without interference from said print screen holder lift assembly arms.

7. The combination print head and print screen holder lift assembly according to claim 1 wherein said means for pivoting said print screen holder include one or more pivot studs affixed to said rear end of said print screen holder.

8. The combination print head and print screen holder lift assembly according to claim 1 wherein each of said print screen holder lift assembly arms is positioned beneath and substantially parallel to a respective arm of said print head frame, wherein said means for moving said lift assembly between a first position and a second position, includes means for raising and lowering said screen lift assembly arms in response to a timed sequence of said screen printing machine in said parallel position beneath said arms of said print head frame.

9. The combination print head and print screen holder lift assembly according to claim 8 wherein said raising and lowering means for said screen lift assembly arms comprises a fluid powered cylinder connected by means of a movable arm to a bar transversely interconnecting a bell crank in each print head arm.

10. A method for providing improved operator safety while performing maintenance procedures during automated print screening making use of a multiple print head, screen printing machine, each head including a printing carriage, comprising the steps of:

(a) fixing a print head frame permanently in place in said machine;

(b) positioning a print screen holder together with its secured print screen in spacial relationship below said print head frame;

(c) moving said print screen holder up and down in response to a timed sequence of said screen printing machine; and (d) pivoting, about a rear edge thereof, the front end of said print screen holder upwards by said operator after said operator has stopped said timed sequence of said screen printing machine after the completion of a predetermined stroke, and has positioned the printing carriage beyond the print screen holder.

11. The method according to claim 10, further comprising the step of pivoting said front end of said print screen holder upwards automatically upon said operator turning on an electrical switch after a predetermined stroke in said timed sequence of said screen printing machine.

12. The method according to claim 10 wherein to accomplish said pivoting step involves pivoting said rear edge of said print screen holder, and thereby raising said front end of said print screen holder upwards, said rear edge of said print screen holder includes having pivot studs affixed at left and right sides of said holder adjacent said rear edge of said holder.

* * * * *